United States Patent [19]

Mabie

[11] Patent Number: 4,856,745

[45] Date of Patent: Aug. 15, 1989

[54] ADJUSTABLE ROOF SCAFFOLD SUPPORT

[76] Inventor: Dana Mabie, 49 Potomac St., Rochester, N.Y. 14611

[21] Appl. No.: 312,862

[22] Filed: Feb. 21, 1989

[51] Int. Cl.[4] ..... A47G 29/02

[52] U.S. Cl. ..... 248/237; 182/45

[58] Field of Search ..... 248/237, 235, 238, 148; 182/121, 145, 117, 150, 142, 82, 200

[56] References Cited

U.S. PATENT DOCUMENTS

| | | | |
|---|---|---|---|
| 354,703 | 12/1886 | Huestis | 182/45 |
| 472,867 | 4/1892 | Farland | 248/237 |
| 612,256 | 10/1898 | Mattson | 248/237 X |
| 718,602 | 1/1903 | Chase | 248/237 |
| 786,499 | 4/1905 | Joanson | 248/237 |
| 1,495,868 | 5/1924 | Nielsen | 248/237 |
| 1,599,209 | 9/1926 | Cashman | 248/237 |
| 1,646,923 | 10/1927 | Martens | 248/237 |
| 1,886,921 | 11/1932 | Tobin | 182/45 X |
| 2,275,014 | 3/1942 | Hahler | 248/237 |
| 2,496,556 | 2/1950 | Nelson | 182/45 X |
| 2,729,517 | 1/1956 | Hamilton | 248/237 |
| 4,020,921 | 5/1977 | Rawlings | 182/45 |
| 4,342,374 | 8/1982 | Montana | 248/237 |

*Primary Examiner*—J. Franklin Foss

*Attorney, Agent, or Firm*—Howard J. Greenwald

[57] ABSTRACT

A triangular, adjustable roof scaffolding support which weighs from about 3 to about 4.5 pounds and which preferably has a duty rating of at least about 2,000 pounds is disclosed. This scaffolding support contains a steel base, means for attaching said steel base to the surface of a roof, a first adjustable aluminum arm hingably attached to one portion of said base, means for hingably attaching said first aluminum arm to one portion of said base, a second adjustable aluminum arm hingably attached to another portion of said base, means for attaching said second aluminum arm to said other portion of said base, means for attaching said first aluminum arm and said second aluminum arm to each other, and means for securing a plank to at least one of said adjustable aluminum arms.

20 Claims, 5 Drawing Sheets

FIG. 6
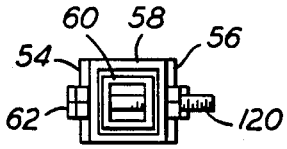
FIG. 9
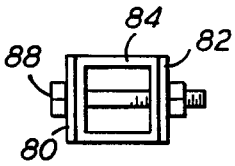
FIG. 7
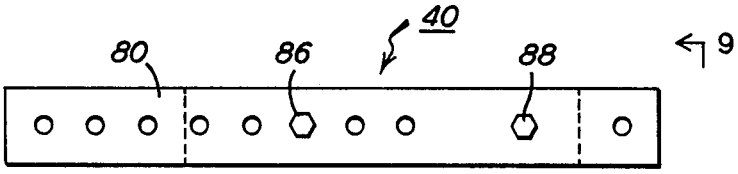
FIG. 8
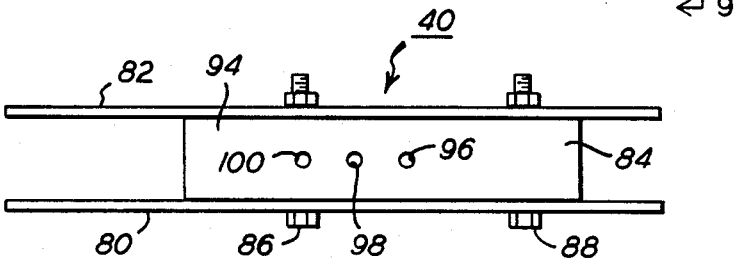
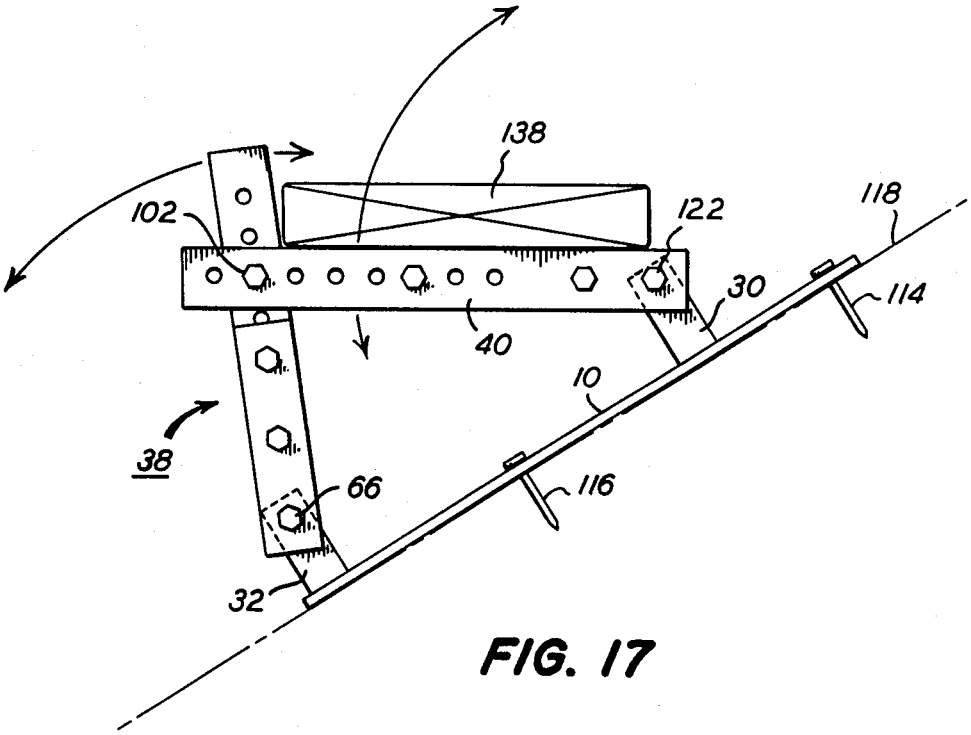
FIG. 17

ADJUSTABLE ROOF SCAFFOLD SUPPORT

FIELD OF THE INVENTION

An adjustable, triangular roof scaffold device is disclosed.

BACKGROUND OF THE INVENTION

Roof scaffold devices are well known to those skilled in the art. By way of illustration, triangular scaffold devices are disclosed in U.S. Pat. No. 354,703 of Huestis, No. 472,867 of Farland, No. 612,256 of Mattson, No. 718,602 of Chase, No. 786,499 of Johnson, No. 1,495,868 of Nielsen, No. 2,275,014 of Hahler, and No. 4,342,374 of Montana.

Despite the many adjustable scaffold devices disclosed in the prior art, applicant is not aware of any such prior art device which is lightweight, is versatile enought to allow a range of angles (pitches) ranging from a three inch pitch to a 12 inch pitch (or greater), is versatile enough to be used with 2'×6' or 2×8' or 2'×10' boards, and is reasonably strong.

It is an object of this invention to provide a scaffold device which is lightweight, is versatile enought to allow a range of angles (pitches) ranging from a three in 12 inch pitch to a 28 in 12 inch pitch (or greater), is versatile enough to be used with 2'×6' or 2×8' or 2'×10' board, and is strong.

SUMMARY OF THE INVENTION

In accordance with this invention, there is provided a triangular, adjustable roof scaffolding support which weighs from about 3 to about 4.5 pounds. This scaffolding support contains a steel base, means for attaching said steel base to the surface of a roof, a first adjustable aluminum arm hingably attached to one portion of said base, means for hingably attaching said first aluminum arm to one portion of said base, a second adjustable aluminum arm hingably attached to another portion of said base, means for attaching said second aluminum arm to said other portion of said base, means for attaching said first aluminum arm and said second aluminum arm to each other, and means for securing a plank to at least one of said adjustable aluminum arms. The steel base contains a steel plate and two U-shaped brackets attached to and extending upwardly from the surface of the steel plate, and each of the U-shaped brackets contains a hole extending through both of the walls of the bracket. The first adjustable aluminum arm contains a first aluminum plate comprised of a multiplicity of holes extending through its side, a second aluminum plate comprised of a multiplicity of holes extending through its side, a first aluminum square tubular section comprised of a multiplicity of holes extending through at least two of its opposing sides, means for securing said first aluminumn plate to one side of said first aluminum square tubular member, and means for securing said second aluminum plate to the opposing side of said first aluminum square tubular member. The second adjustable aluminum arm comprises a third aluminum plate comprised of a multiplicity of holes extending through its side, a fourth aluminum plate comprised of a multiplicity of holes extending through its side, a second aluminum square tubular section comprised of a multiplicity of holes extending through at least two of its opposing sides, means for securing said third aluminumn plate to one side of said second aluminum square tubular member, and means for securing said fourth aluminum plate to the opposing side of said second aluminum square tubular member.

DESCRIPTION OF THE DRAWINGS

The present invention will be more fully understood by reference to the following detailed description thereof, when read in conjunction with the attached drawings, wherein like reference numerals refer to like elements and wherein:

FIG. 6 is an end view of the first adjustable arm;

FIG. 7 is a side view of the second adjustable arm of the scaffold device;

FIG. 8 is a top view of the second adustable arm;

FIG. 9 is an end view of the second adjustable arm;

FIG. 17 is a sectional view of the scaffold of FIG. 15 adjusted to another position.

DESCRIPTION OF THE PREFERRED EMBODIMENTS

Figure 1:
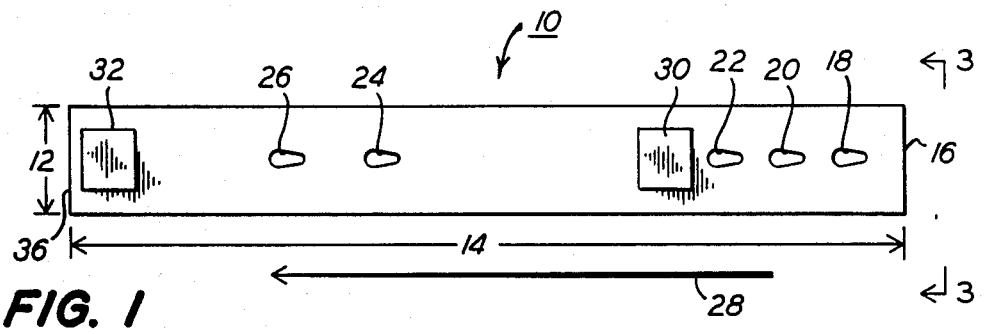
FIG. 1 is a top view of the base of applicant's scaffold device.

One of the preferred embodiments of this invention is illustrated in the Figures. FIG. 1 is a top view of the base of applicant's scaffold device.

Referring to FIG. 1, base 10 is shown. Base 10 preferably consists essentially of steel.

As is known to those skilled in the art, steel is iron with carbon chemically dissolved in it. Low carbon steel contains from about 0.15 to about 0.30 percent of carbon. Medium carbon steel contains from about 0.30 to about 0.60 percent of carbon. High carbon steel contains from about 0.60 to about 0.90 percent of carbon.

The compositions and properties of standard steels are described on pages 23–54 and 23–55 of Robert H. Perry and Cecil H. Chilton's "Chemical Engineers'-Handbook," Fifth Edition (McGraw-Hill Book Company, New York, 1973), the disclosure of which is hereby incorporated by reference into this specification. By way of illustration and not limitation, some of the preferred steels which can be utilized in the scaffold of this invention include S.A.E. steels 950 (a low alloy steel with a Brinnel hardness of 150, a tensile strength of from 65,000 to 70,000 p.si., and yield point of from 45,000 to 50,000 p.s.i.), 1025 (a low carbon steel with a tensile strength of from 60,000 to 103,000 p.s.i., a Brinnell hardness of from 150 to 175, and a yield point of from 40,000 to 90,000 p.s.i.), 1045 (a medium carbon steel with a tensile strength 80,000 to 182,000 p.s.i., a yield point of 50,000 to 162,000, and a Brinnel hardness of from 125 to about 310), and the like.

Base 10 preferably has a thickness of at least about 0.064 inches (14 gage). It is preferred that the thickness of base 10 be from about 0.091 inches (11 gage) to about 0.162 inches (7 gage). In the most preferred embodiment, the thickness of base 10 is from about 0.128 inches (8 gage).

Base 10 preferably has a width 12 from about 2.0 to about 2.25 inches. The length 14 of base 10 is preferably from about 14.0 to about 23.5 inches; in one preferred embodiment, such length 14 is about 17 inches.

Although the preferred embodiment of base 10 illustrated in FIG. 1 has a substantially rectangular shape, it will be appreciated by those skilled in the art that other shapes also may be utilized.

Near the top 16 of base 10 are located three nail holes 18, 20, and 22; in other embodiments, not shown, differnet numbers and/or locations of the nail holes may be used. One or more nails may be driven through these holes into a roof (not shown in FIG. 1) to secure the scaffold device of this invention to the roof. In the preferred embodiment illustrated in FIG. 1, base 10 also comprises nail holes 24 and 26.

In one preferred embodiment, holes 18, 20, 22, 24, and 26 are have a substantially oval shape, with each of their smallest ends closest to top 16 of base 10, so that, when force is applied on base 10 in the direction of arrow 28, the nail heads (not shown) will tend to move towards the narrow ends of said holes and, thus, firmly secure base 10 to the roof (not shown).

The substantially oval shapes of holes 18, 20, 22, 24, and 26 can be made by means well known to those skilled in the art. Thus, by way of illustration and not limitation, one can use double drilled holes with, e.g., a 0.5 inch and a 0.22 inch hole drilled over a 0.5 inch drill out.

In one preferred embodiment, the center of hole 18 is about 1.75 inches from top 16, the center of hole 20 is about 2.5 inches from top 16, the center of hole 22 is about 3.75 inches from top 16, the center of hole 24 is about 10.0 inches from top 16, and the center of hole 26 is about 14.0 inches from top 16.

Figure 2:
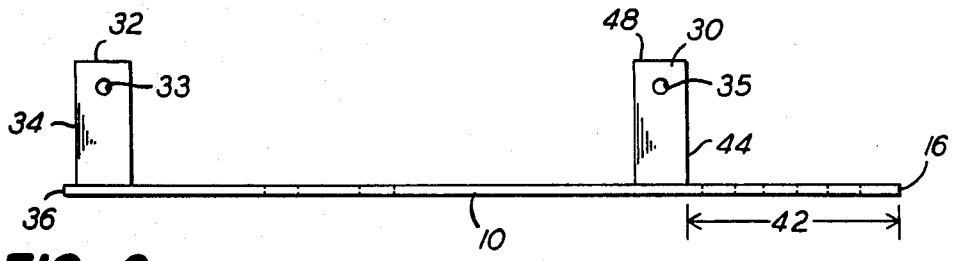
FIG. 2 is a side view of the base.
Figure 3:
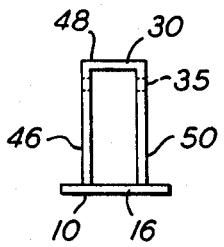
FIG. 3 is an end view of the U-shaped bracket located on the base.

Attached to base 10 are two integral, U-shaped brackets 30 and 32 which are shown in more detail in FIGS. 2 and 3.

FIG. 2 is a side view of base 10. It is preferred that edge 34 of bracket 32 be positioned as close as possible to bottom 36 of base 10. In this preferred embodiment, the distance between bottom 36 and edge 34 is usually less than about 0.5 inches.

Bracket 30 is positioned a suitable distance from top 16 of base 10 so that, after adjustable arm 38 has been attched to bracket 32 and after adjustable arm 40 has been attached to bracket 30, said adjustable arms will form an angle of from about 30 to about 60 degrees with each other. In general, the distance 42 beteween top 16 of base 10 and edge is from about 25 to about 40 percent of the length 14 of base. Thus, by way of illustration and not limitation, in one embodiment base 10 is 17 inches long and bracket 30 is located about 5.5 inches in from top 16 of base 10.

Each of brackets 30 and 32 preferably consists essentially of steel. In one preferred embodiment, the same steel used to make base 10 is used to make each of brackets 16.

In one preferred embodiment, each of brackets 30 and 32 is substantially the same thickness as base 10, ranging from about 0.064 inches to about 0.162 inches, and preferably being about 0.128 inches. In this preferred embodiment, each of brackets 30 and 32 is about 1.5 inches wide and about 2.75 inches high.

It is preferred that each of brackets 30 and 32 be integral, substantially U-shaped devices. These brackets 30 and 32 may be made by metal bending techniques well known to those skilled in the art. Thus, by way of illustration, a substantially rectangular piece of steel about 7.0 inches long can be bent so that it is 2.75 inches from the plate bottom to the top of the bend, 1.5 inches on the top of the bend, and 2.75 inches down to the bottom of the plate.

U-shaped brackets 30 and 32 each have a hole extending through each of their arms. Thus, by way of illustration, a hole 33, which is from about 0.375 inches to about 0.438 inches in diameter, may be located about 2.0 inches from the bottom of bracket 32. A similar hole 35 may be located in bracket 30.

Each of brackets 30 and 32 may be secured to base 10 by means well known to those skilled in the art. Thus, e.g., these brackets may be secured to base 10 by riveting. It is preferred, however, to secure them to base 10 by welding them.

The preparation of welded joints is well known to those skilled in the art. Thus, by way of illustration, it is described on pages 535 to 538D of Volume 14 of the McGraw-Hill Encyclopedia of Science and Technology (McGraw-Hill Book Company, New York, 1977), the disclosure of which is hereby incorporated by reference into this specification.

In one preferredembodiment, brackets 30 and 32 are attached to base 10 by stick metal arc welding ("SMAW"). Thus, e.g., these brackets may be arc welded to the base with a $\frac{1}{8}$" American Welding Society (AWS) classificaiton rods in the series from E6010 to E6027 and E7010 to E7028, and the like. Using from about 85 to about 145 amperes direct current positive. It is preferred to use rods which have tensile strengths of from about 62,000 to about 67,000 p.s.i. and yield strengths of from about 50,000 to about 55,000 p.s.i.

A preferred embodiment of bracket 32 is illustrated in FIG. 3, which is an end view of base 10, looking at bottom end 36. Bracket 32 (and bracket 30) are integral, U-shaped devices with arm 46, top 48, and arm 50; each of arms 46 and 50 are about 2.75 inches in length, and top 48 is about 1.5 inches in length. The angle formed between arm 46 and top 48 is substantially 90 degrees. The angle formed between top 48 and arm 50 is substantially 90 degrees.

Bracket 32 is so secured to base 10 so that it defines a channel 52 extending towards the length 14 of base 10. In one preferred embodiment, bracket 30 is also similarly disposed so that channel 52 is aligned with the channel (not shown) of bracket 30. Such alignment is preferred so that, when adjustable arms 38 and 40 are connected to the brackets, they will be in substantial alignment with each other.

Two adjustable arms, arms 38 and 40, are secured to brackets 32 and 30, respectively, to form the scaffold of this invention. Some or all of the components in these arms are comprised of aluminum. As used in this specification, the term aluminum refers to both unalloyed aluminum and aluminum alloy.

Figure 4:
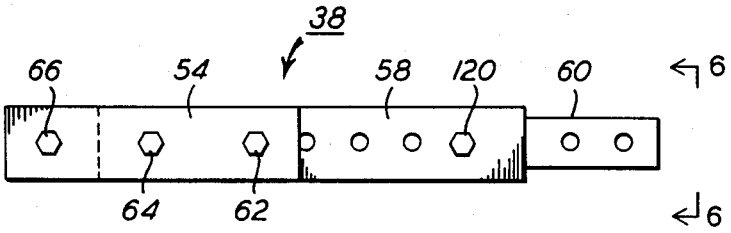
FIG. 4 is a side view of the first adjustable arm of the scaffold device.
Figure 5:
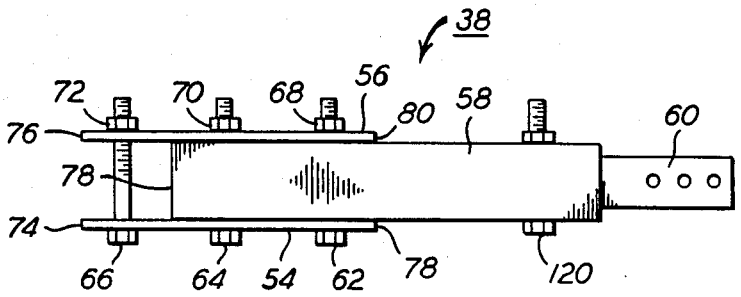
FIG. 5 is a top view of the first adjustable arm.

Referring to FIG. 4, a side view of adjustable arm 38 is shown. In the preferred embodiment illustrated in FIG. 4, adjustable arm 38 is comprised of plate 54, plate 56 (not shown), tubular section 58, and tubular section 60.

Tubular section 60 fits within tubular section 58, and both are sandwiched between plates 54 and 56. Thus, sections 58 and 60 must have shapes so that one can fit within the other. By way of illustration, both of such shapes may be square. Alternatively, both of such shapes may be rectangular. In one embodiment, one shape is square and the other shape is rectangular. It is preferred that both of these sections have square shapes, and such square shapes will be referred to in the remainder of this specification.

Each of plates 54 and 56 are comprised of three holes (not shown) into which bolts 62, 64, and 66 can be inserted; these bolts are preferably about 2.785 inches long and consist essentially of steel. In one preferred embodiment, said bolts a ⅜" number 2 hex bolts with tensile strengths of from about 75,000 to about 100,000 p.s.i., with yield strengths of about 55,000 p.si., and with proof strengths of about 80,000 p.s.i. When these bolts are passed through one or more comparable holes in square tubular section 58 and secured by wing nuts 68, 70, and 72, square tubular section 58 can be secured to plates 54 and 56.

Each of plates 54 and 56 preferably consists essentially of aluminum alloy. As used in this specification, the term aluminum alloy refers to an alloy of aluminum with one or more metals. Aluminum alloys are well known to those skilled in the art and are described, e.g., on pages 39–44 G. S. Brady and H. R. Clauser's "Materials Handbook," Twelfth Edition (McGraw-Hill Book Company, New York, 1986), the disclosure of which is hereby incorporated by reference into this specification. One preferred aluminum alloy is is T-6061 aluminum alloy, which is an alloy containing 1.0 magnesium, 0.6% silicon 0.25%, chromium, 0.25% copper, and the balance being aluminum, including normal impurities; this preferred aluminum alloy has a tensile strength of 60,000 p.s.i., a yield strength of 40,000 p.s.i., a shear strength of 30,000 p.s.i., and a Brinnel hardness of 95.

In one preferred embodiment, each aluminum plate 54 and 56 is about 0.188 inches thick, 1.5 inches wide, and 6.0 inches long; and, in this embodiment, holes with diameters of about 0.375 inches are drilled through the sides of plates 54 and 56 at distances of 1.0 inch, 3.0 inches, and 5.0 inches, respectively, from bottoms 74 and 76 of said plates.

Square tubular section 58 is so disposed between plates 54 and 56 that section 58 extends the required distance from tops 78 and 80 of plates 54 and 56. Tubular section 58 also has holes with diameters of about 0.375 inches drilled through it. The extent to which section 58 extends past tops 78 and 80 of the plates depends upon which of said hole(s) in section 58 bolts 62 and/or 64 and/or 66 are inserted through.

Square tubular section 58 preferably consists essentially of aluminum alloy. In one preferred embodiment, the aluminum alloy material in section 58 is substantially identical to the aluminum alloy material used in plates 54 and 56.

In one preferred embodiment, square tubular section 58 has a thickness of about 0.125 inches, each side is about 1.5 inches, and it is about 8.5 inches long; and holes with diameters of about 0.375 inches are located at about 1, 3, 4, 5, 6, and 7 inches from bottom 78 of square tubular section 58.

In one preferred embodiment, in addition to being comprised of plate 54, plate 56, and square tubular section 58, adjustable arm 38 also comprises square tubular section 60. The use of section 60 allows one to further extend the length of arm 38.

Square tubular section 60 may consist essentially of either steel or aluminum alloy. It is preferred to use aluminum alloy for this part, but steel may be used in situations where strength is a very important consideration. In one preferredembodiment, the thickness of the walls of square tubular section 60 is about 0.125 inches, and the length of section 60 is about 7.75 inches. Inasmuch as section 60 must fit within section 58, each of the walls of section 60 must be smaller than the walls of section 58. In one preferred embodiment, each of the walls of section 60 is about 1.5 inches. In another preferred embodiment, each of said walls is about 1.0 inch. Holes with diameters of about 0.375 inches are located about 1, 2, 3, 4, 5, 6, and 7 inches from the bottom (not shown) of square tubular section 60.

Referring to FIG. 6, a top view of adjustable arm 38 is illustrated.

Referring to FIG. 7, a side view of adjustable arm 40 is shown. In the preferred embodiment illustrated in FIG. 7, adjustable arm 40 is comprised of plate 80, plate 82(not shown), and tubular section 84. Tubular section 84 is preferably either sqare or rectangular in shape and, most preferably, has a square shape.

Each of plates 80 and 82 are preferably comprised of ten holes (some of which are shown in FIG. 7), into which bolts (such as bolts 88 and 86) can be inserted; these bolts are preferably about 2.785 inches long and consist essentially of steel. In one embodiment, the holes are located 1, 3, 5, 6, 7, 8, 9, 10, 11 and 12 inches from the bottom of each of the plates. When these bolts are passed through one or more comparable holes in tubular section 84 and secured by nuts 90 and 92, square tubular section 84 can be secured to plate 80 82.

Each of plates 80 and 82 preferably consists essentially of aluminum alloy, such as, e.g., T-6061 aluminum alloy.

In one preferred embodiment, each aluminum plate 80 and 82 is about 0.188 inches thick, 1.5 inches wide, and 13.0 inches long.

Square tubular section 84 is so disposed between plates 80 and 82 so that the top 94 of section 84 is suitbly disposed tp to receive a plank. In the top 94 of section 84 are holes which may be used to help secure a plank to section 84. In one embodiment, the holes are about 3 inches, 4 inches, 5 inches, and 7 inches from the top of section 84. The planks may be secured to section 84 by bolts extending through one or more clamps and section 84 and the plank(s) to be secured thereto, wherein said bolts are secured by, e.g., wing nuts. By choosing different increments at which bolts extend through the clamps, planks, and section 84, different size planks may be secured.

Square tubular section 84 preferably consists essentially of aluminum alloy. In one preferred embodiment, the aluminum alloy material in section 84 is substantially identical to the aluminum alloy material used in plates 54 and 56.

In one preferred embodiment, square tubular section 84 has a thickness of about 0.188 inches, each side is about 1.5 inches, and it is about 7.75 inches long; and holes with diameters of about 0.375 inches are located at about 1, 2, 3, 4, 5, and 6 inches from the bottom of the section.

FIG. 9 is a top view of adjustable arm 40.

Figure 10:
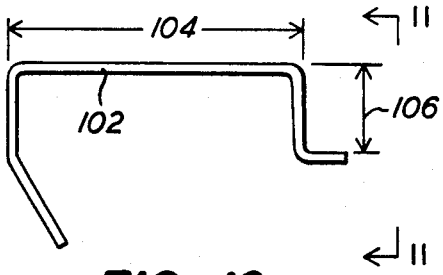
FIG. 10 is a side view of a first clamp which can be used with the scaffold device.
Figure 11:
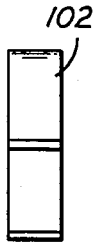
FIG. 11 is an end view of the first clamp.

FIG. 10 is a side view of clamp 102 which, in conjunction with square tubular section 84, may be used to secure a plank to the scaffold device of this invention. Clamp 102 may be prepared by means well known to those skilled in the art. In one preferred embodiment, it is made from 14 gage steel and bent to substantially the shape illustrated in FIG. 10 so that length 104 is 5.5 inches and height 106 is 1.5 inches. FIG. 11 is a side view of the clamp of FIG. 10.

Figure 12:
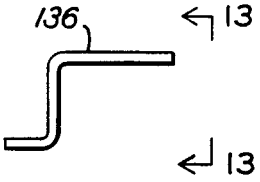
FIG. 12 is a side view of a second clamp which can be used with the scaffold device.
Figure 13:
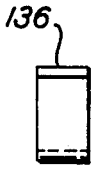
FIG. 13 is an end view of the second clamp.

FIG. 12 is a side view of a clamp which may be used to secure a plank to the top of section 84. This clamp also may be made from 14 gage steel and bent so that, in one preferred embodiment, length 110 is 2.0 inches and height 112 is 1.5 inches. FIG. 13 is a side view of the clamp of FIG. 12.

One may place metal bends over the board planks to be attached to square tubular section 84. These metal bends may be fastened with steel bolts which are run through the square tubular section 84 and fastened on the underside of the section.

Figure 14:
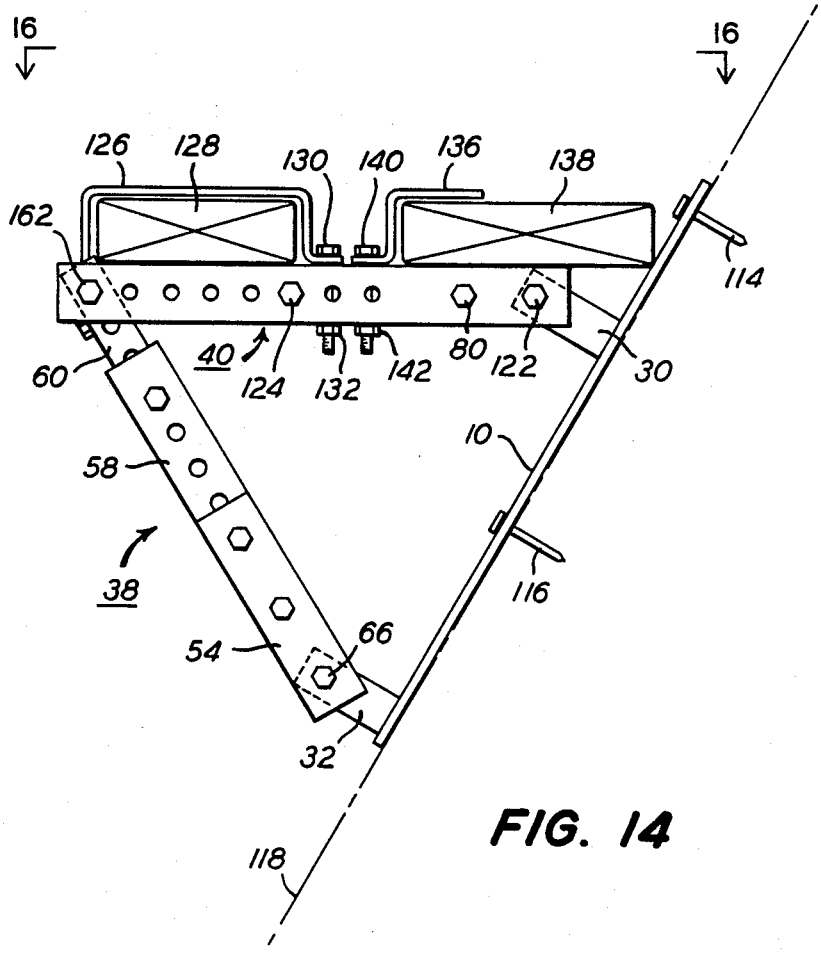
FIG. 14 is a sectional view of one scaffold device in place on a roof.

In one embodiment, illustrated in FIG. 14, nails 114 and 116 and driven through holes in scaffold base 10 and into roof surface. Adjustable arm 38 is attached to U-shaped bracket 32 by means of a bolt 66 extending through a hole (not shown) in U-shaped bracket 32, through a hole (not shown) in plate 54, through square tubular section 58, and through plate 56 (not shown). Bolts 62 and 64 also secure plate 54, square tubular section 58 (not shown), and plate 56 (not shown).

Square tubular section 60 is attached to square tubular section 58 by a bolt extending through square tubular section 60. The top portion of square tubular section 60 is secured to adjustable arm 40 by bolt 162. Bolt 162 extends through a hole (not shown) in tubular section 60,m through a hole (not shown) in plate 80, through a hole (not shown) in plate 82 (not shown), and through a nut which secures the whole assembly.

Adjustable arm 58 is attached to U-shaped bracket 32 by means of a bolt 66 extending through a hole (not shown) in U-shaped bracket 32, through a hole (not shownb) in plate 54, through square tubular section 58, and through plate 56 (not shown). Bolts 62 and 64 also secure plate 54, square tubular section 58 (not shown), and plate 56 (not shown).

Adjustable arm 40 is secured to U-shaped bracket 30 by means of bolt 122 which extend through a hole (not shown) in plate 80, through a hole (not shown) in square tubular section 84 (not shown), and through a hole (not shown) in plate 82 (not shown). Bolt 124 is also used to secure plates 80 and 82 to square tubular section 84.

Clamp 126 may be used to ecure plank 128 to adjustable arm 40. One end of clamp 126 may be secured to arm 40 by means of a bolt 130 which extends through a hole (not shown) in clamp 126, a hole (now shown) in top 94 of tubular section 84, and through nut 132. The other end of clamp 126 may be secured to square tubular section 60 by a bolt which extends through a hole (not shown) in the other end of clamp 126, through holes (not shown) in the top and bottom of tubular section 60, and through a nut (not shown).

Alternatively, or additionally, a clamp may be used to secure plank 138 to adjustable arm 40 by means of bolt 140 and nut 142.

Figure 15:
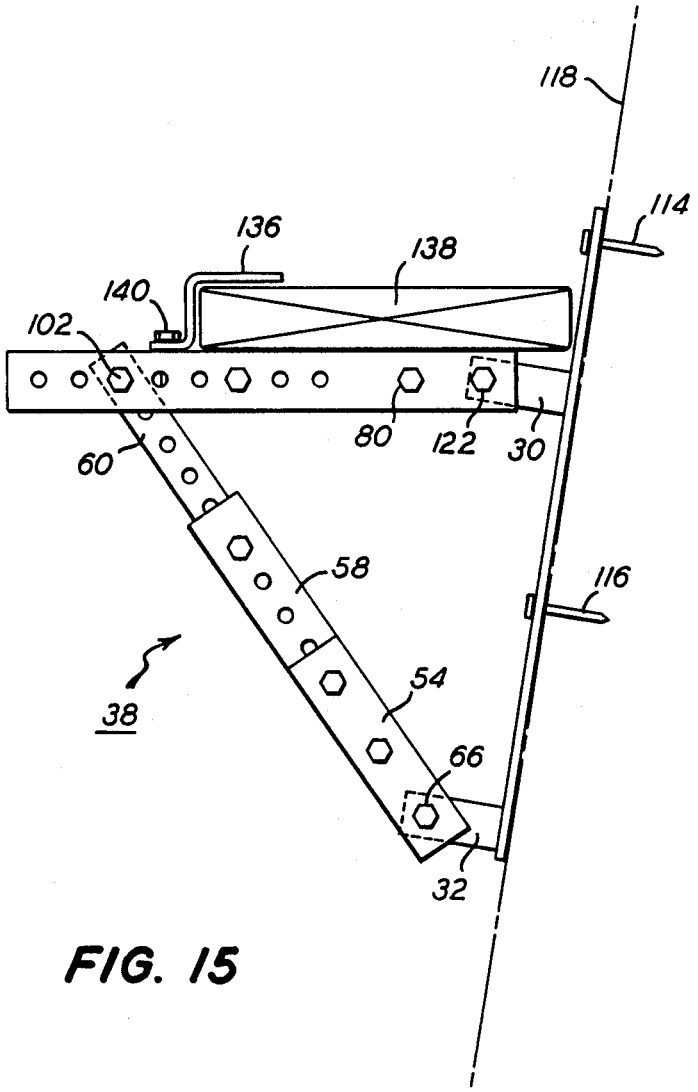
FIG. 15 is a sectional view of another scaffold device in place on a roof.

FIG. 15 illustrates another embodiment of the scaffold device of this invention.

Figure 16:
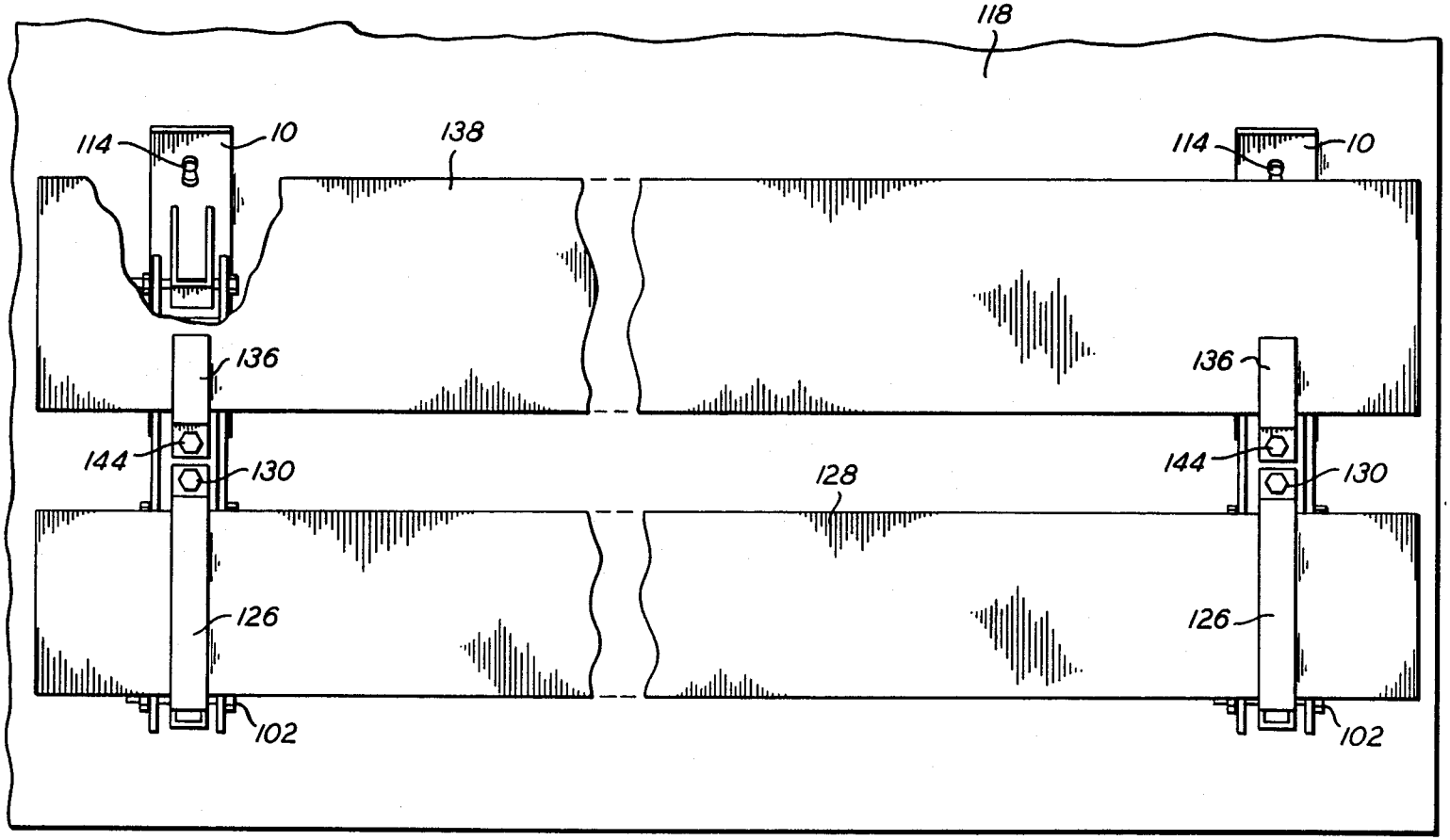
FIG. 16 is a top view of a preferred embodiment of the scaffold device of this invention in use on a roof surface; p

FIG. 16 is a top view of two of the scaffold devices of this invention in use on a roof surface.

FIG. 17 is another such view of the scaffold device adjusted to a different pitch. The scaffold depicted in FIG. 17 allows one to facilitate various pitches from about 4/12 pitch to about Mansard pitch. When the pitch on which the scaffold devie is to be used is varied, placmenet of nails thorugh base 10 may be varied to accommodate the different stress loads placed upon the scaffold unit.

Applicant's triangular, adjustable roof scaffolding device is lightweight. It weighs from about 3 to about 4.5 pounds.

The scaffold of this invention preferably has a duty rating of of at least about 2,000 pounds.

Although the invention described in the Figures has been described with particularity, it will be understood that other inventions are within the scope of the invention.

The connection of steel base 10, aluminum adjustable arm 40, and adjustable arm 38 by bolts and nuts produces a triangular frame. Although the Figures show adjustable ars 38 and 40 being substantially straight, one or both of them may be curved (see, e.g., said Huestis patent).

The base of the scaffold device preferably consists essentially of steel. However, other suitably strong materials also can be used.

The adjustable aluminum arms of the scaffold are hingably attached to steel base. Although the Figures indicate making such attachment with a bolt, other means of attachment also may be used. Thus, e.g., the arms may be attached to the base by means of rivets.

I claim:

1. A triangular, adjustable roof scaffolding support which weighs from about 3 to about 4.5 pounds, comprising a steel base, means for attaching said steel base to the surface of a roof, a first adjustable aluminum arm hingably attached to one portion of said base, means for hingably attaching said first aluminum arm to one portion of said base, a second adjustable aluminum arm hingably attached to another portion of said base, means for attaching said second aluminum arm to said other portion of said base, means for attaching said first aluminum arm and said second aluminum arm to each other, and means for securing a plank to at least one of said adjustable aluminum arms, wherein:

(a) said steel base is comprised of a steel plate and two U-shaped brackets attached to and extending upwardly from the surface of said steel plate, wherein each of said U-shaped brackets comprises a hole extending through both of the walls of said bracket;

(b) said first adjustable aluminum arm comprises a first aluminum plate comprised of a multiplicity of holes extending through its side, a second aluminum plate comprised of a multiplicity of holes extending through its side, a first aluminum square tubular section comprised of a multiplicity of holes extending through at least two of its opposing sides, means for securing said first aluminumn plate to one side of said first aluminum square tubular member, and means for securing said second aluminum plate to the opposing side of said first aluminum square tubular member; and (c) said second adjustable aluminum arm comprises a third aluminum plate comprised of a multiplicity of holes extending through its side, a fourth aluminum plate comprised of a multiplicity of holes extending through its side, a second aluminum square tubular section comprised of a multiplicity of holes extending through at least two of its opposing sides, means for securing said third aluminumn plate to one side of said second aluminum square tubular member, and means for securing said fourth aluminum plate to the opposing side of said second aluminum square tubular member.

2. The scaffolding support as recited in claim 1, wherein said support has a duty rating of at least about 2,000 pounds.

3. The scaffolding support as recited in claim 2, wherein said steel base has a thickness of at least about 0.064 inches.

4. The scaffolding support as recited in claim 3, wherein said steel base has a width of from about 2.0 to about 2.25 inches.

5. The scaffolding support as recited in claim 4, wherein said steel base has a length of from about 14.0 to about 23.5 inches.

6. The scaffolding support as recited in claim 5, wherein each of said U-shaped brackets consist essentially of steel.

7. The scaffolding support as recited in claim 6, wherein each of said U-shaped brackets has a thickness of at least about 0.064 inches.

8. The scaffolding support as recited in claim 7, wherein the thickness of said steel base is from about 0.091 to abut 0.162 inches.

9. The scaffolding support as recited in claim 8, wherein the thickness of each of said U-shaped brackets is from about 0.064 to about 0.162 inches.

10. The scaffolding support as recited in claim 9, wherein each of said U-shaped brackets is welded to said steel base.

11. The scaffolding support as recited in claim 10, wherein each of said first aluminum plate, said second alumninum plate, said third aluminum plate, and said fourth aluminum plate consist essentially of aluminum alloy.

12. The scaffolding support as recited in claim 11, wherein each of said first aluminum square tubular member and said second aluminum square tubular member consist essentially of aluminum alloy.

13. The scaffolding support as recited in claim 12, wherein said steel base has a substantially rectangular shape.

14. The scaffolding support as recited in claim 13, wherein at least three holes are located near the top of said steel base.

15. The scaffolding support as recited in claim 4, wherein each of said nail holes has a substantially oval shape.

16. The scaffolding support as recited in claim 15, wherein one of said U-shaped brackets is attached at a point on said steel base which is from about 25 to about 40 percent of the length of said steel base away from the top of said steel base.

17. The scaffolding support as recited in claim 16, wherein one of said U-shaped brackets is attached near the bottom of said steel base.

18. The scaffolding support as recited in claim 17, wherein each of said steel brackets is about 1.5 inches wide.

19. The scaffolding support as recited in claim 18, wherein each of said steel brackets is about 2.75 inches high.

20. The scaffolding support as recited in claim 19, wherein said means for securing a plank to at least one of said adjustable aluminum arms comprises a clamp.

* * * * *